US005265689A

United States Patent [19]

Kauffmann

[11] Patent Number: 5,265,689

[45] Date of Patent: Nov. 30, 1993

[54] PROSTHETIC DEVICE FOR LIFTING AND LOWERING A PERSON THEREON

[76] Inventor: Ricardo M. Kauffmann, Prol. Ave. Americas 1213, Guadalajara, Mexico

[21] Appl. No.: 939,550

[22] Filed: Sep. 1, 1992

Related U.S. Application Data

[63] Continuation of Ser. No. 640,948, Jan. 14, 1991, abandoned.

[51] Int. Cl.[5] ..... A61G 5/04

[52] U.S. Cl. ..... 180/65.5; 5/81.1; 180/907; 297/330; 297/DIG. 4; 297/DIG. 10

[58] Field of Search ..... 180/6.5, 65.1, 65.5, 180/907; 5/81 R, 81 B, 86; 297/DIG. 4, DIG. 10, 330

[56] References Cited

U.S. PATENT DOCUMENTS 4,054,319 10/1977 Fogg, Jr. et al. ..... 297/DIG. 10
4,456,086 6/1984 Wiek et al. ..... 297/DIG. 10
4,809,804 3/1989 Houston et al. ..... 180/907

FOREIGN PATENT DOCUMENTS 776610 11/1980 U.S.S.R. ..... 180/907

*Primary Examiner*—Mitchell J. Hill
*Attorney, Agent, or Firm*—Boniard I. Brown

[57] ABSTRACT

A prosthetic device operable by a handicapped user of the device for physically lifting and lowering the user's body to and supporting the user's body in an upright standing position and a sitting position. The disclosed prosthetic embodiments are motorized wheel chairs.

23 Claims, 9 Drawing Sheets

PROSTHETIC DEVICE FOR LIFTING AND LOWERING A PERSON THEREON

This is a continuation of copending application Ser. No. 07/640,948 filed on Jan. 14, 1991 now abandoned.

BACKGROUND OF THE INVENTION

1. Field of the Invention

This invention relates generally to prosthetic devices and more particularly to an improved prosthetic device of the class which are operable to support the user of the device in both sitting and standing positions.

2. Prior Art

Handicapped persons frequently suffer from depression which may be quite severe when the handicap is particularly debilitating or is acquired relatively suddenly as a result of an accident or illness. Paraplegia and quadraplegia are examples of the severe handicaps. In most cases such depression is due not only to the physical and psychological stress which the handicap itself exerts on the body of a handicapped person but also to the loss of independence and earning power which he experiences as a result of the handicap. Accordingly, one way of alleviating the depression of many handicapped persons is to restore to the extent possible their independence and employment capability.

A wide variety of prosthetic devices have been devised for enabling handicapped persons to perform functions which they could not otherwise perform and thereby restoring to some extent their independence and employment capabilities. One such prosthetic device which is particularly beneficial to persons suffering from paralysis of at least the lower body, such as paralegics and quadraplegics, is a wheel chair. A conventional wheel chair, as its name implies, is essentially a chair which is mounted on wheels for movement from one location to another and is designed to support the user in a sitting position. Some wheel chairs are motorized and equipped with controls which the user may operate to drive and steer such wheel chairs.

Conventional wheel chairs, then, are quite satisfactory for use in those situations in which a sitting position is comfortable and appropriate. Such a sitting position, however, is not always the most comfortable or appropriate. For example, prolonged orientation of a person in a sitting position can become quite uncomfortable, and the comfort of a wheel chair user can be significantly enhanced by enabling the user to periodically assume an upright standing position. Moreover, most people can converse with another person or persons with the greatest ease and least emotional stress when they don't have to look up or down at the other persons. In the case of a handicapped person seated in a conventional wheel chair, this condition exists only if other persons seated and hence would often not exist in many social and other situations where it is impossible or inappropriate for non-handicapped persons to sit. Accordingly, it would be highly desireable for a wheelchair-bound person to be able to assume a standing position in such situations. Another situation in which it is often highly desireable, if not absolutely essential, for a handicapped person in a wheel chair to assume a standing position is in a work environment where the work task assigned to the person can be performed most effectively or only in a standing position.

For the reasons just stated, prosthetic devices commonly referred to as wheel chairs have been devised which enable the handicapped user to assume both sitting and standing positions. Examples of such "sit/-stand" prosthetic devices or wheel chairs are described in U.S. Pat. Nos. 4,054,319, 4,456,086, and 4,809,804. While these and other similar sit/stand prosthetic devices or wheel chairs are capable of performing their intended functions, they have certain deficiencies which this invention overcomes. Among the foremost of these deficiencies are the following: an excessive number of parts and resulting excessive complexity and relatively high cost of manufacture; excessive overall size and weight; lack of means for effectively aiding the handicapped user to assume standing and sitting positions by physically but gently lifting and lowering the handicapped user to these positions; inability to quickly and easily dissassemble or collapse the devices for ease of storage and transportation. Accordingly, there is a definite need for an improved sit/stand prosthetic device or wheel chair.

SUMMARY OF THE INVENTION

This invention provides such an improved sit/stand prosthetic device and wheel chair which overcome the above and other deficiencies of the existing devices of this kind. The improved prosthetic device of the invention has a base, a seat for seating the user in a normal sitting position, an upper body support engagable with the user's upper body, and seat and upper body support positioning means including a power operated lifter on the base for elevating and lowering the seat and upper body support between user standing positions and user seating positions. In the user standing positions, the upper body support is elevated above the base an appropriate distance to engage the user's body in a certain supporting relation above the waist in such a way as to support the user in an upright standing position, and the seat is retracted to enable the user to assume this standing position. In the user seating positions, the seat is extended generally horizontally to seat the user in a normal sitting position, and the upper body support is lowered relative to the base to engage the user's body in said certain supporting relation above the waist so as to support the user's upper body in the sitting position.

The lifter is selectively operable in raising and lowering modes by user actuated means which are easily accessible to the user throughout the range of adjustment of the prosthetic device between and including its user standing and user seating configurations. During the raising mode of the lifter, the upper body support is elevated while in supporting engagement with the user's upper body in such a way that the upper body support physically but gently lifts the user from the sitting position to the standing position. The seat retracts as the user is thus lifted to the standing position in order to enable the user to assume the standing position. During the lowering mode of the lifter, the upper body support is lowered while in supporting engagement with the user's upper body in such a way that the upper body support physically but gently lowers the user from the standing position to the sitting position. The seat extends to its user seating position as the user is thus lowered so as to seat the user when he arrives at the sitting position.

Certain presently preferred prosthetic devices are described. These devices are motorized, battery powered wheel chairs having wheels on the base for movement of the wheel chairs along the ground. Certain of these wheels are motor driven for propelling the chairs.

The lifter of the wheel chairs is a hydraulic lifter including an upright piston fixed to the wheel chair base and a cylinder slidable on the piston. Hydraulic fluid is fed to and vented from the lifter to raise and lower the lifter by a hydraulic system including a hydraulic fluid storage tank and manual and electrical motor driven hydraulic pumps which are mounted on and move up and down with the lifter cylinder.

The upper body support of these described embodiments comprises padded body support arms which are engagable under the arm pits of the user in somewhat the same way as the upper ends of crutches. These support arms are mounted on and thus raise and lower with the lifter cylinder in such a way they physically but gently raise and lower the user to the standing and sitting positions. The user actuated means of the wheel chairs include a manually operable pump handle for the manual pump and a user actuated electrical control unit which is operable by the user to electrically operate the lifter hydraulic system and the wheel drive means and to steer the wheel chair. The pump handle and control unit are also mounted on and raise and lower with the lifter cylinder so as to remain easily accessible to the user throughout the range of adjustment of the wheel chair between and including its user standing and user seating positions. The described embodiments may be quickly and easily collapsed for ease of storage and transportation and one embodiment is adjustable to accomodate persons of different height.

DESCRIPTION OF THE PREFERRED EMBODIMENTS

Figure 1:
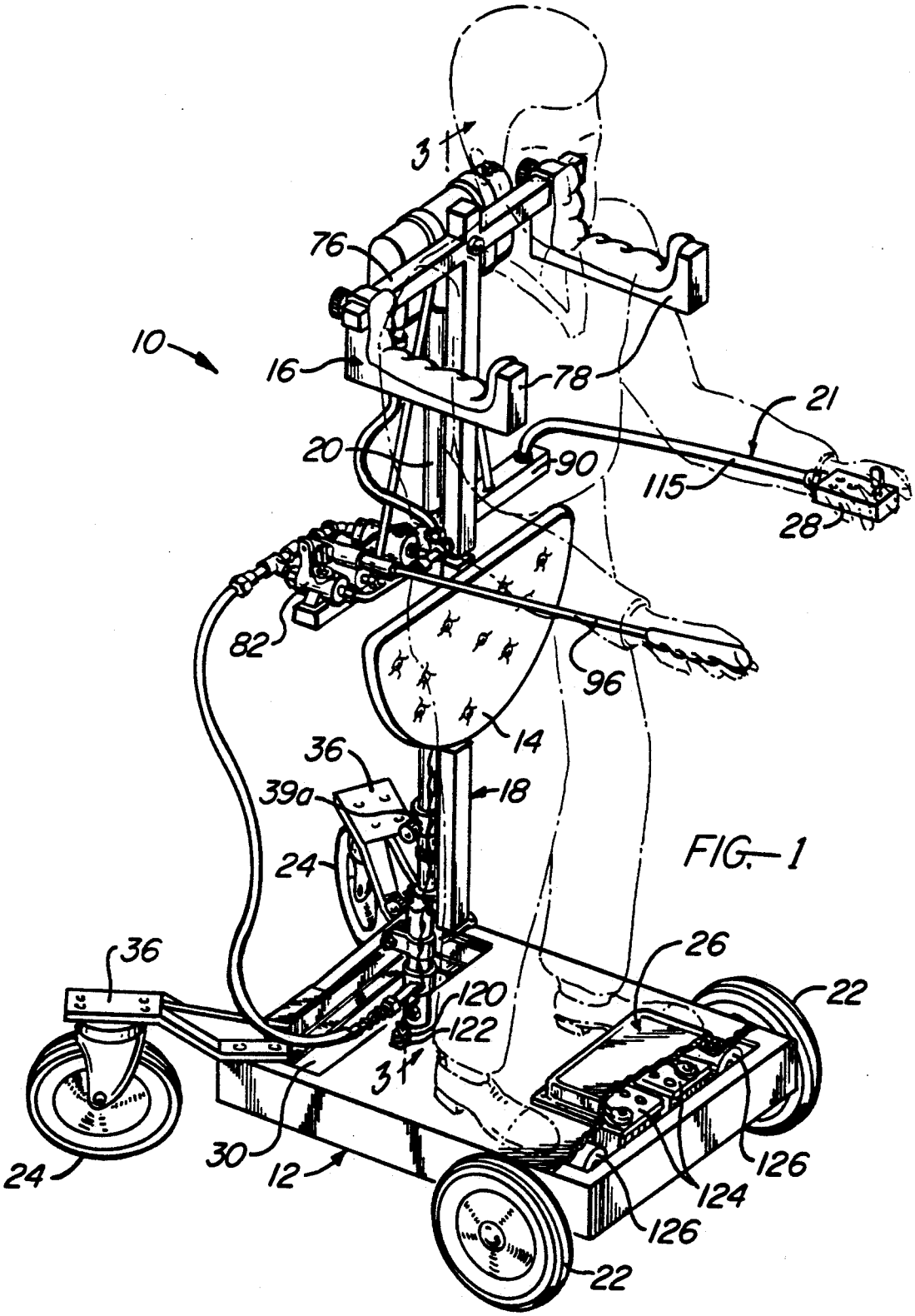
FIG. 1 is a perspective view of a sit/stand prosthetic device, in this case a wheel chair, according to the invention showing the device in its user standing configuration.

Turning now to FIGS. 1–8 of these drawings, the illustrated prosthetic sit/stand device 10 has a base 12, a seat 14 for supporting the user in a sitting position, an upper body support 16 engagable in supporting relation with the user's upper body above the waist, and seat and upper body support positioning means 18 operatively connected to the seat and upper body support. Positioning means 18 includes a power actuated lifter 20 and is operable in response to raising and lowering of the filter to move the seat 14 and upper body support 16 between their user standing positions of FIG. 1 and their user seating positions of FIG. 2. In the user seating positions of FIG. 2, the seat 14 is extended horizontally to seat the user in the sitting position shown. The upper body support 16 is lowered relative to the base 12 to support the user's upper body portion, that is the portion of the user's body above the waist. In the user standing position of FIG. 1, the upper body support 18 is elevated relative to the base to support the user's body in standing position. The seat 14 is retracted vertically to permit the user to occupy the standing position.

The prosthetic device 10 is operated and controlled by user actuated means 21 which can be selectively actuated by the user or occupant of the device to operate the lifter 20 in an elevating mode and a lowering mode. During operation of the lifter in its elevating mode, the positioning means 18 effects upward movement of the upper body support 16 and seat 14 from their user seating positions of FIG. 2 to their user standing positions of FIG. 1. During operation of the lifter in its lowering mode, the positioning means 18 effects downward movement of the upper body support and seat from their user standing positions of FIG. 1 to their user sitting positions of FIG. 2. In both the elevating mode and the lowering mode of the lifter, the user's body is supported by the upper body support 16 in such a way that that this body support physically but gently lifts the user's body from the sitting position to the standing position in the elevating mode and lowers the user's body from the standing position to the sitting position in the lowering mode.

The preferred prosthetic sit/stand device illustrated is a mobile device, referred to herein as a wheel chair, having front and rear wheels 22, 24 on the base 12 which support the wheel chair for movement along the ground. The front wheels 22 are driven by an electrically powered drive system 26 which is operable to both propel and steer the wheel chair. The user actuated means 21 of the wheel chair include both manually and electrically powered means, to be described presently, for operating the lifter 20 and an electrical control system 27 for controlling the electrically powered lifter operating means and the electrically powered front wheel drive system 26. One element of this electrical control system is a control unit 28 which can be selectively actuated by the wheel chair user to raise and lower the lifter 20 and thereby place the wheel chair in its user standing and user seating configurations, and to energize the drive system 26 in such a way as to propel and steer the wheel chair. As described later, the wheel chair includes parts which are separable and collapsible in the manner illustrated in FIG. 8 for ease of transportation and storage of the chair. The wheel chair is also adjustable to accommodate users of different height.

Referring now in more detail to the drawing FIGS. 1–8, the wheel chair base 12 is a hollow rectangular housing having an access opening (not shown) to the housing interior. Near the rear end of the base is a transverse opening 30 through the base. Extending along the front edge of this opening and rigidly joined to the base are a pair of U-section channels 32 disposed one over the other with their flanges vertically aligned and extending toward one another. Front wheels 22 are rotatably mounted at opposite sides of the base 12 at its front end for rotation on fixed, substantially aligned transverse axes of the base. The rear wheels 24 are swivel wheels mounted on brackets 36 rigidly joined to opposite sides of the base 12 at its rear end. These rear wheels swivel freely on substantially vertical swivel axes.

Lifter 20 comprises an upstanding hydraulic lifter assembly including a lower stationary lifter part 38 in the form of a cylindrical piston and an upper movable lifter part 40 in the form of a cylinder which slides on the stationary piston. The lifter parts, that is, the piston 38 and cylinder 40, have a common longitudinal axis 20*a* (FIG. 4) which is referred to herein as a lifter axis. The lower end of the piston 38 fits removably within a socket 41 extending through and welded to the base channels 32. This socket retains the lifter 20 in a fixed position and at a fixed angle relative to the base 12 wherein the lifter axis 20*a* is at least nearly vertical when the prosthetic devide rests on the floor or other horizontal surface. The lifter piston 38 is releasably secured within the socket 41 by a bolt 42. Rigid on the piston just above the socket is a bracket 43 which is releasably secured by a bolt 44 to an upstanding support plate 45 welded to the base 12 and to the base channels 32 for supporting the lifter laterally. Bracket bolt 44 engages in a vertical slot in the support plate 45 to facilitate separation of the lifter 20 from the base 12 in the manner explained later.

At the upper end of the lifter cylinder 40 is a hydraulic fluid storage tank 46 having a mounting bracket 48 attached by a bolt 50 to the upper cylinder end. Near the lower end of the lifter piston 38 is a fluid port 52 which communicates with a fluid passage 54 extending axially through the piston and opening at its upper end through a restriction in the passage to a fluid chamber 56 formed between the upper ends of the piston and the cylinder 40.

As mentioned earlier and described in more detail later, the lifter 20 is selectively operable in an elevating mode and a lowering mode in response to actuation of user actuated means 21 by the wheel chair user. During the elevating mode, hydraulic fluid is pumped from the tank 46, through the fluid port 52 and fluid passage 54 of the lifter, to the lifter chamber 56 to effect upward extension of the lifter cylinder 40 relative to the lifter piston 38. During the lowering mode of the lifter, the lifter chamber 56 is vented back to the tank 46 to permit downward retraction of the cylinder 40 relative to the piston 38 by the force of gravity.

In addition to the lifter 20, the seat and upper body support positioning means 18 comprises an elongate support bar 58 member 58 in the form of an elongate support bar at the front side of and extending longitudinally of the lifter. At the rear side of this support bar near its upper end is a bracket 60 which is attached by the bolt 50 to the upper end of the lifter cylinder 40. Near its lower end, the support bar 58 is attached to the cylinder 40 by a releasable coupling 62. The seat 14 is pivotally secured along its rear edge to the lower end of the support bar 58 by a hinge 64. The positioning means also includes a seat strut 66 pivotally attached at its upper end by a hinge 68 to the front edge of the seat 14 and at its lower end by a hinge 70 to a bracket 72 on the lower end of the lifter piston 38. Bracket 72 has arms which straddle the piston are joined by a screw 74 which can be tightened to secure the bracket in fixed position along the piston. The pivot axes of the hinges 64, 68, 70 are substantially parallel to one another and normal to the longitudinal axis of the lifter 20 and extend transversely of the base 12.

The upper body support 16 comprises a cross arm 76 at the upper end of the support bar 58. Slidable on opposite ends of this cross arm and extending forwardly therefrom are padded, upper body support arms 78. These upper body support arms are generally similar to and are adapted to engage under arm pits of the wheel chair user in much the same way as the upper ends of crutches. The support arms 78 are adjustable along the cross arm 76 to accommodate users of different upper body widths and have clamp screws 80 for securing the support arms in fixed positions along the cross arm.

Figure 3:
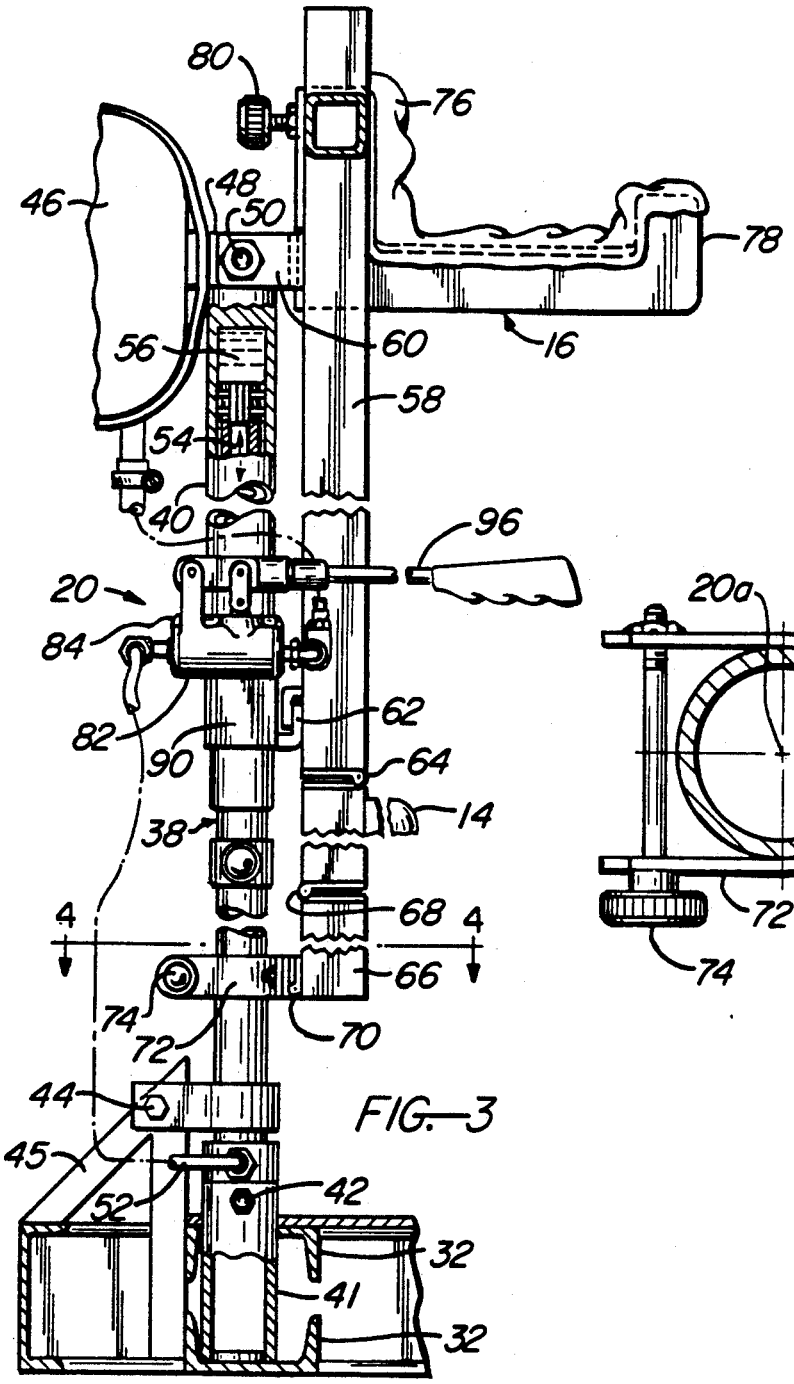
FIG. 3 is an enlarged section taken on line 3—3 in FIG. 1.
Figure 4:
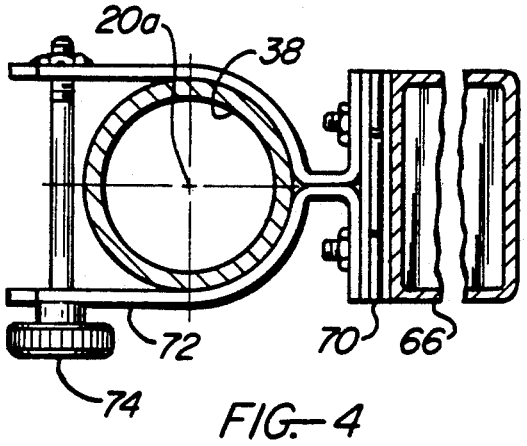
FIG. 4 is a section taken on line 4—4 in FIG. 3.
Figure 5:
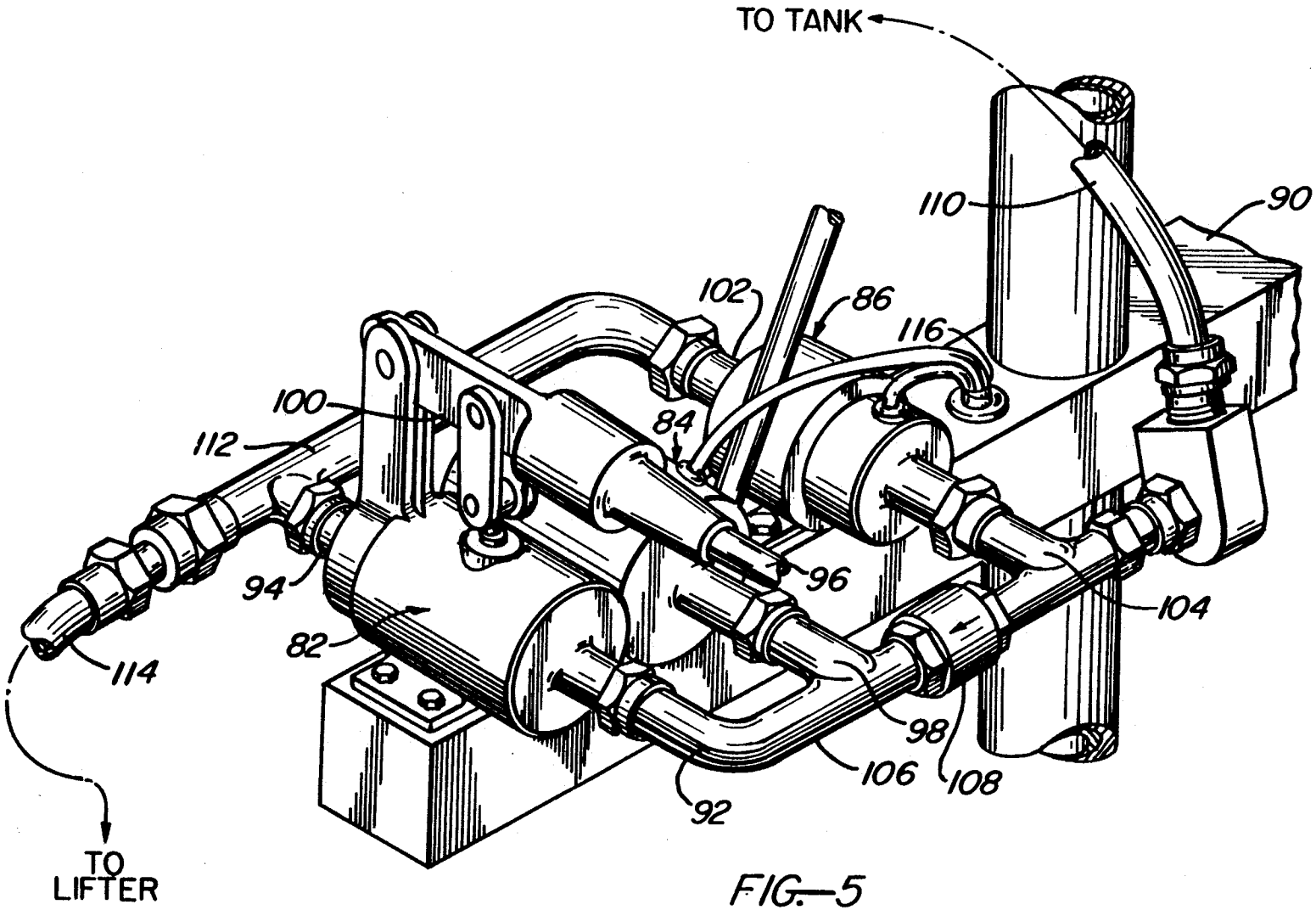
FIG. 5 is an enlarged fragmentary detail of the wheel chair.

Since the support bar 58 is secured to the lifter cylinder 40, the bar, and hence also the rear edge of the seat 14 which is hinged to the lower end of the bar, the upper body support arms 78 which are mounted on the upper end of the bar, and the upper end of the seat strut 66 which is hinged to the front edge of the seat elevate and lower with the cylinder. When the lifter 20 occupies its upper extended position of FIGS. 1 and 3, shown in solid lines in FIG. 6, the support bar 58 and seat strut 66 are substantially longitudinally aligned on a common, normally generally vertical axis parallel to the longitudinal axis of the lifter, and the seat 14 is retracted upwardly into a vertical transverse plane of the wheel chair containing the common axis of the support bar and strut. The upper body support arms 78 are elevated relative to the base 12. These positions of the seat and upper body support arms are referred to herein as their user standing positions. When the seat and upper body support arms occupy these user standing positions, the wheel chair is conditioned to support the user in the standing position shown in FIG. 1.

Figure 2:
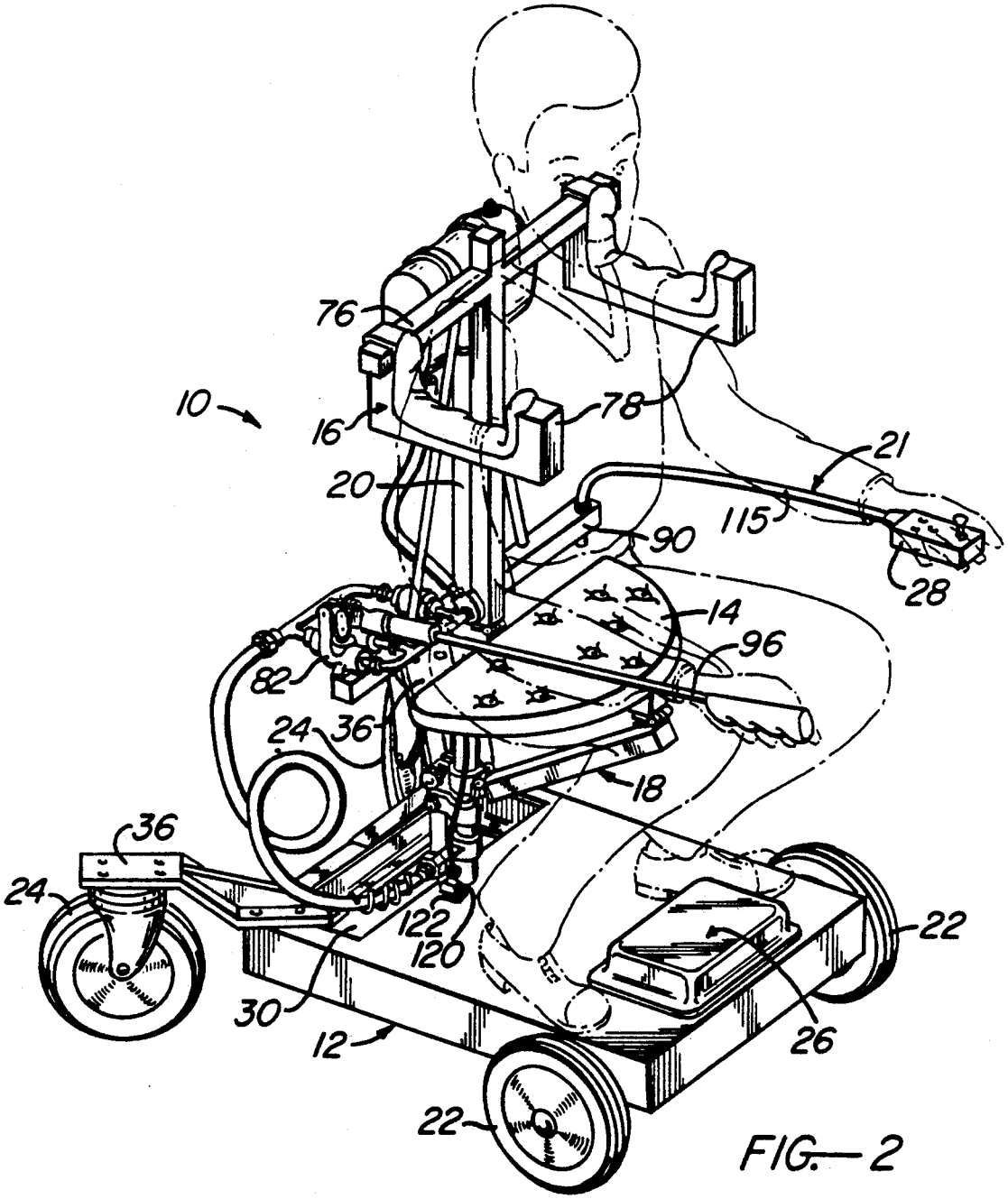
FIG. 2 is a section similar to FIG. 1 showing the wheel chair in its user seating configuration.
Figure 6:
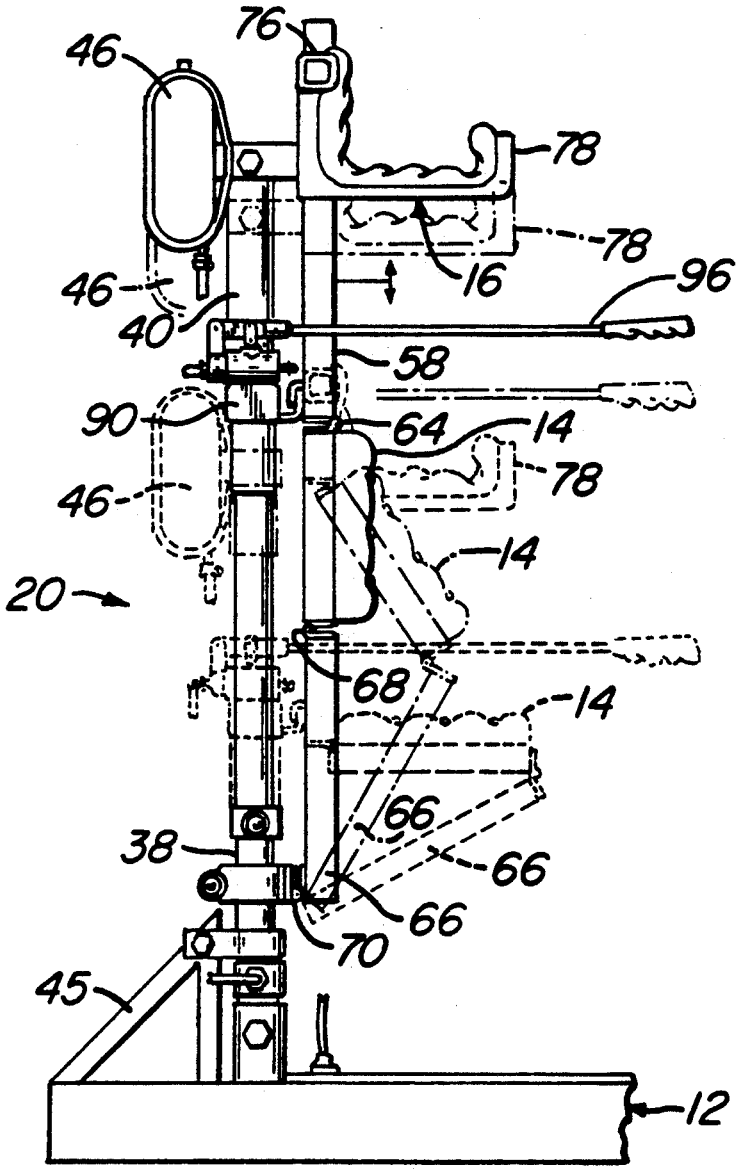
FIG. 6 illustrates adjustment of the wheel chair between its user standing position of FIG. 1 and its user seating position of FIG. 2.
Figure 7:
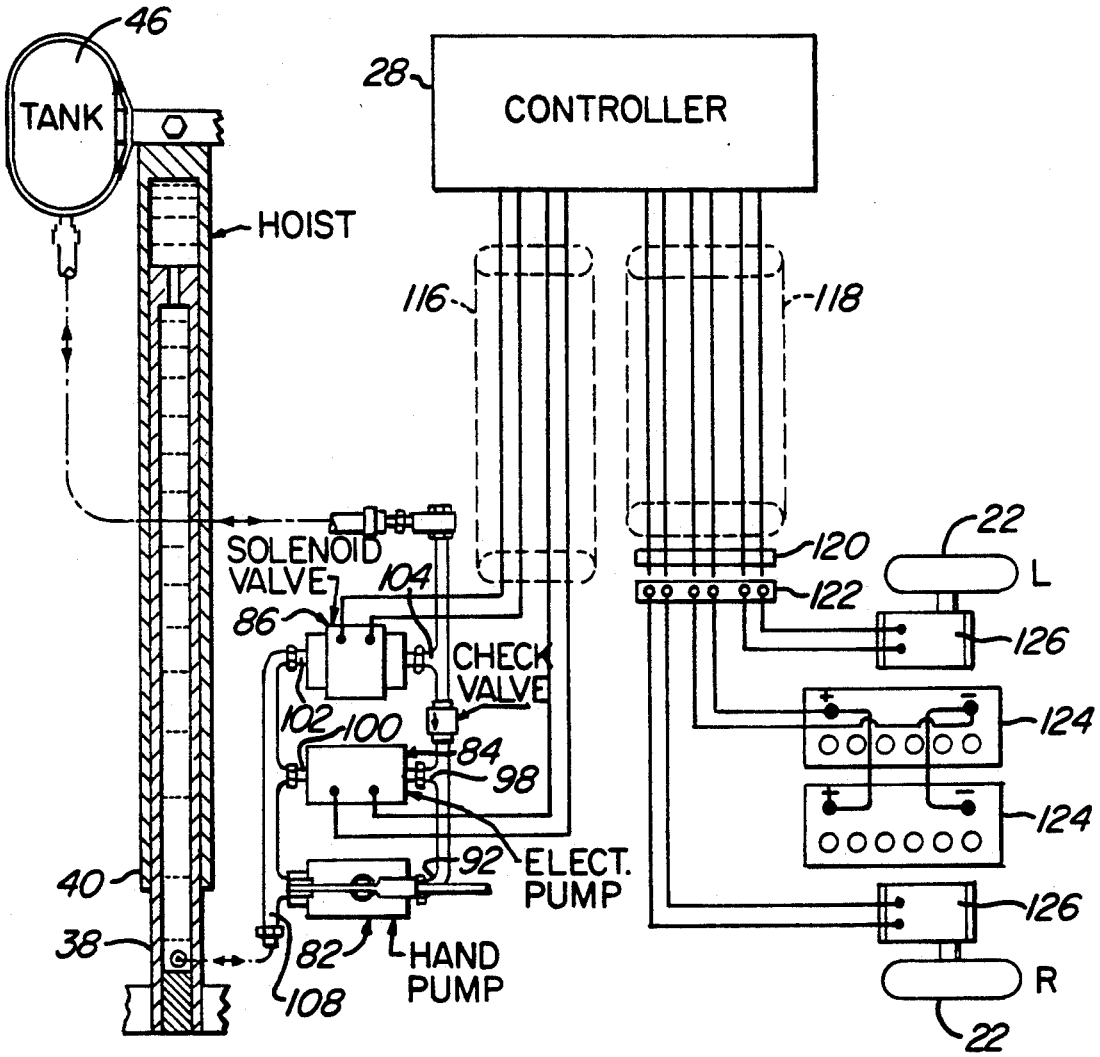
FIG. 7 is a schematic electrical and hydraulic diagram of the wheel chair.

During lowering of the lifter 20 from its upper extended position of FIGS. 1 and 3 to its lower retracted position of FIG. 2, shown in phantom line in FIG. 6, the support bar 58 and hence the upper body support arms 78 descend in the endwise direction of the bar through their broken line positions of FIG. 6 to their phantom line positions of FIG. 6 (which are the positions shown in FIG. 2). Also during this lowering of the lifter, the seat strut 66 rotates clockwise (in FIG. 6) about its lower hinge 70, and the seat 14 undergoes combined counterclockwise rotation and forward edgewise translation from its solid line position, through its broken line position, to its phantom line position of FIG. 6 (which is the position shown in FIG. 2).

The positions of the seat 14 and upper body support arms 78 shown in FIG. 2 are referred to herein as their user seating positions. When the upper body support arms and seat occupy these seating positions, the wheel chair is conditioned to support the wheel chair user in the sitting position shown in FIG. 2. During elevation of the lifter 20 from its lower retracted position of FIG. 2 back to its upper extended position of FIG. 1, the seat strut 66 rotates counterclockwise in FIG. 6, and the seat 14 undergoes combined rearward edgewise translation and clockwise rotation to its retracted user standing position of FIG. 1.

As noted above, the lifter 20 is selectively operable by actuation of the use actuated means 21 to elevate and lower the seat 14 and upper body support arms 78 between their user standing positions of FIG. 1 and their user seating positions of FIG. 2. These user actuated means include a manual hydraulic pump 82, a motor driven hydraulic pump 84, a solenoid valve 86, and the electrical control system 27 which controls the motor driven pump 54 and solenoid valve 86. The manual pump 82, motor driven pump 84, and solenoid valve 86 are mounted on a cross arm 90 rigid on the lower of the lifter cylinder 40 and extending laterally of the wheel chair.

Manual pump 82 has an inlet 92, an outlet 94, a handle 96 which is movable by hand with a pumping motion to pump hydraulic fluid from the inlet 92 to the outlet 94, and means (not shown) for blocking reverse flow through the pump. Motor driven pump 84 has an inlet 98, an outlet 100, motor driven pumping means (not shown) for pumping hydraulic fluid from the inlet 98 to the outlet 100 in response to energizing of the pump, and means (not shown) for blocking reverse flow through the pump. Solenoid valve 86 has an inlet 102, an outlet 104, and normally closed electrically actuated valve means (not shown) which may be actuated to open the valve. Connected to the pump inlets 92, 98 and to the solenoid valve outlet 104 is a manifold 106. This manifold contains a check valve 108 between the solenoid valve 86 and the pumps 82, 84 which opens to permit flow only in the direction of the arrow in FIG. 5. The manifold 106 is connected to the bottom of the hydraulic fluid tank 46 through a hose 110. Connected to the pump outlets 94, 100 and the solenoid valve inlet 102 is a manifold 112 which is connected by a hose 114 to the hydraulic fluid port 52 of the lifter 20.

The manual pump 82 is mounted at one outer end of the lifter cross arm 90 with the pump handle 96 extending forwardly from the cross arm. Secured to and extending forwardly from the opposite end of the lifter cross arm 90 is a support arm 115 which mounts the user actuated control unit 28. As is evident from the drawings and will be discussed in more detail later, the control unit 28 and pump handle 96 raise and lower in unison with the seat 14 and the upper body support arms 78 during upward extension and downward retraction of the lifter 20 and are located in positions where they are easily accessible to the wheel chair user in both the user standing configuration and user seating configuration of the wheel chair.

The control unit 28 is electrically connected by a first electrical cable 116 to the motor driven pump 84 and the solenoid valve 86. A second electrical cable 118 having a plug 120 for insertion into a socket 122 in the top of the base 12 electrically connects the control unit 28 to a battery 124 and front wheel drive motors 126 within the wheel chair base 12. The drive motors 126 constitute the wheel chair drive system 26 and are drivabably connected to the two front wheels 22, respectively. The two motors are separately controllable to both propel and steer the wheel chair. The control unit 28 has control elements which operate switching and motor speed control means within the unit and which are easily selectively operated by the wheel chair user. The control system 27 includes and electrically interconnects the electrical switching and motor speed control means within the control unit 28, the motor driven pump 84, the solenoid valve 86, the battery 124, and the front wheel drive motors 126 in such a way that the battery may be selectively connected to the motor driven pump, the solenoid valve, and/or the front wheel drive motors to energize the same, and the speeds of the front wheel drive motors may be separately controlled by appropriate actuation of the control elements on the control unit.

The operation of the sit/stand wheel chair 10 will now be described. Depending upon the nature and severity of his handicap, the person who is going to use the wheel chair is either helped into or physically placed in the chair, normally with the chair in its user seating configuration of FIG. 2. The user sits with his back against the support bar 58 and the upper body support cross arm 76 and with his arms extending over the upper body support arms 78 in such a way that these support arms engage under the user's arm pits to support the user's upper body in the sitting position. When in this sitting position, the user can place his left hand on the control unit 28 and his right hand on the pump handle 96 so that the control unit and its support arm and the pump handle provide support for the user's hands and forearms. If desired, the wheel chair may have a belt (not shown) for securing the user to the chair.

When the user wishes to assume a standing position, he either operates the manual pump 82 by moving its handle 96 up and down or actuates the control unit 28 to energize the motor driven pump 84 to pump hydraulic fluid from the tank 46 to the lifter 20 to elevate the lifter and thereby raise the seat 14 and upper body support arms 78 to their user standing positions of FIG. 1. As the upper body support arms 78 rise, they first physically lift the user under his arms from the sitting position of FIG. 2 to the standing position 1 and then continue to support the user in the standing position. The seat 14 retracts upwardly and rearwardly as the upper body support arms 78 rise to permit the user to assume the standing position of FIG. 1.

The user returns to the sitting position of FIG. 1 by actuating the control unit 78 to energize and thereby open the solenoid valve 86, thus venting the lifter 20 to the hydraulic fluid tank 46. The lifter 20, seat 14, and upper body support arms 78 then slowly descend under the force of gravity created by the weight of these parts and the weight of the user. The lifter passage 54 is restricted, as shown, to control the rate of extension and retraction of the lifter in order to assure gentle lifting of the user to the standing position and gentle lowering of the user to the sitting position. It is evident that the wheel chair may be operated to support the user in other positions between the standing position of FIG. 1 and the sitting position of FIG. 2. The lower seat strut bracket 72 is vertically adjustable along the lifter piston 38 to vary the height of the seat 14 above the base 12 when the seat occupies its horizontal user seating position of FIG. 2 in order to accomodate persons of different height.

It is important to note here that the solenoid valve 86, when deenergized, and the pumps 82, 84, when both energized and deenergized, all block reverse hydraulic fluid flow from the lifter 20 back to the hydraulic fluid tank 46 and thus create a hydraulic lock. This hydraulic lock serves to retain the seat 14 and the upper body support arms 78 in their user standing positions of FIG. 1 and their user seating positions of FIG. 2 as well as in any other positions they may occupy.

The user drives the wheel chair forwardly and rearwardly by actuating the control unit 28 to energize the front wheel drive motors 126 in their forward or reverse directions. Operation of these motors at the same speed will propel the wheel chair in a straight line. Steering of the wheel chair is accomplished by operating the motors at different speeds, operating one motor only, or operating the motors in different directions at the same time. An important feature of the wheel chair resides in the fact that the control unit 28 and manual pump 82 raise and lower with the lifter 20 in such a way that they are always positioned for actuation by the user to operate the lifter and drive the wheel chair.

Figure 8:
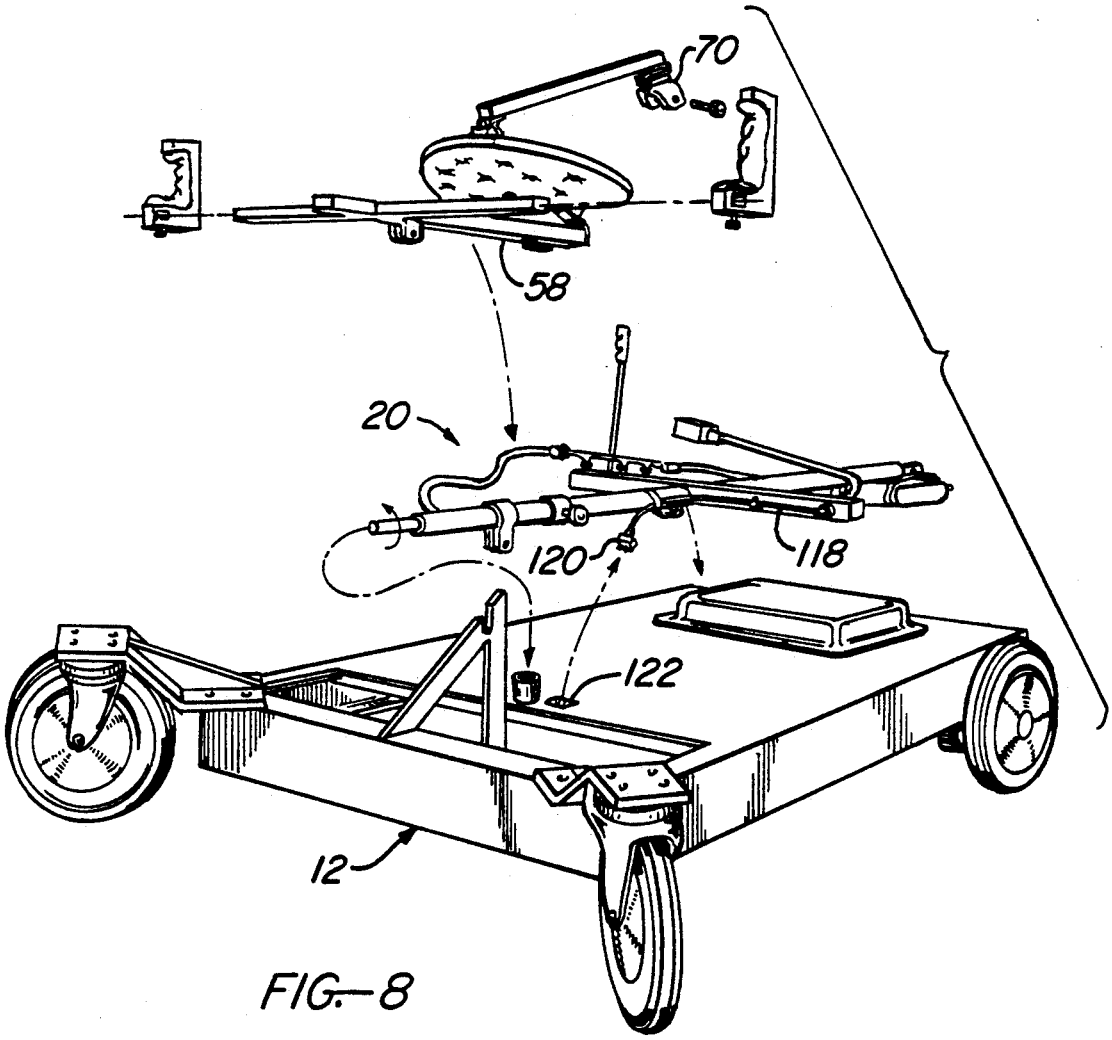
FIG. 8 illustrates the manner in which the wheel chair may be collapsed for storage and transportation.
Figure 9:
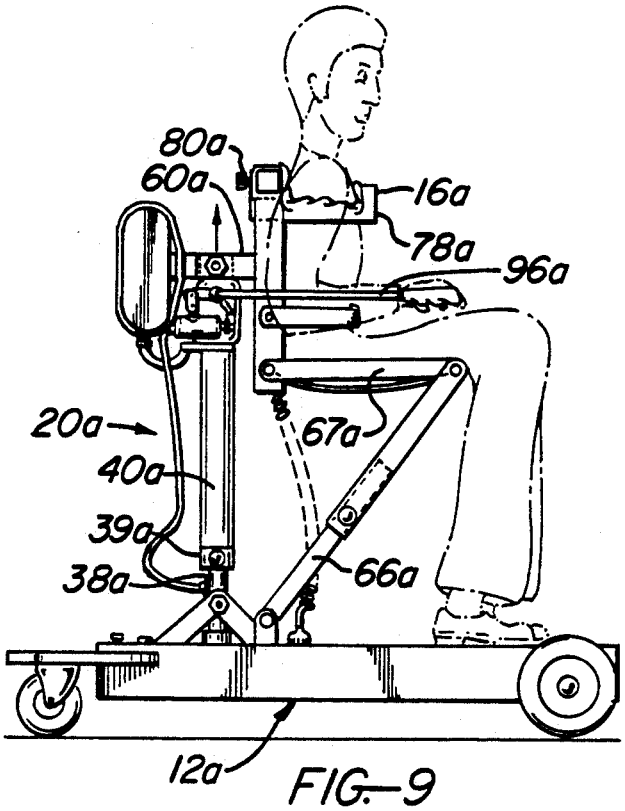
FIG. 9 is a side elevation of a modified sit/stand prosthetic device or wheel chair of the invention.
Figure 10:
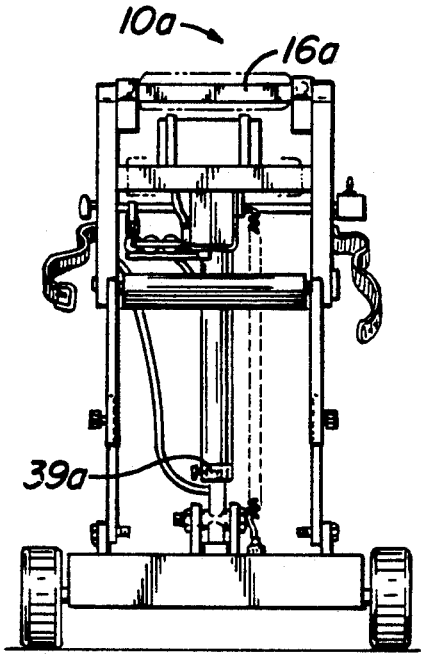
FIG. 10 is a front elevation of the modified wheel chair in FIG. 9.
Figure 11:
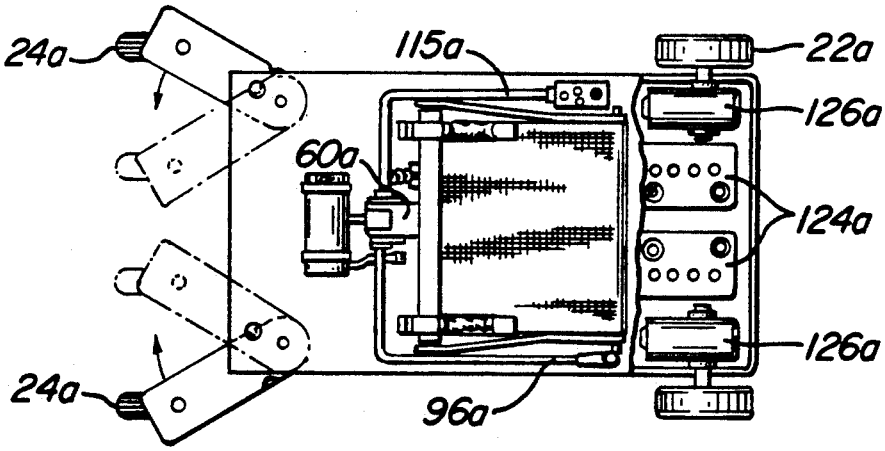
FIG. 11 is a top plan view of the modified wheel chair.
Figure 12:
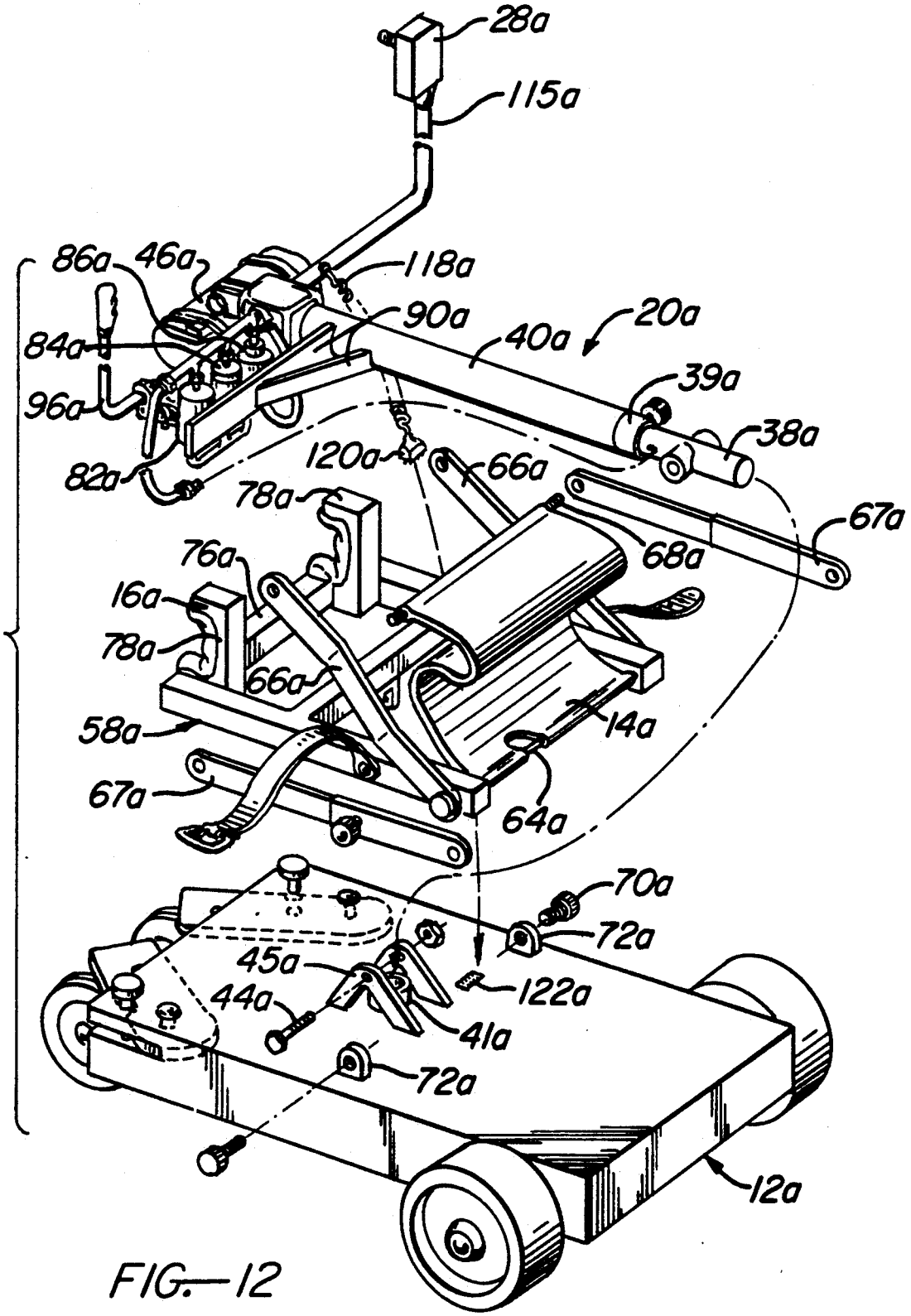
FIG. 12 illustrates the manner in which the modified wheel chair may be collapsed for storage and transportation.

As shown in FIG. 8, the wheel chair may be partially dissassembled and collapsed for ease of storage and transportation. This accomplished by disconnecting the support bar 58 and lower seat brace hinge 70 from the lifter 20 and the lifter from the base 12 and then stacking the disassembled parts on the base in the manner illustrated in FIG. 8.

FIG. 9–12 illustrate a modified sit/stand wheel chair 10*a* according to the invention. The wheel chair 10*a* is essentially identical in many respects to the wheel chair 10 of FIGS. 1–8. For this reason, the parts of the wheel chair 10*a* which have essentially identical counterparts in the wheel chair of FIGS. 1–8 will be described in somewhat abreviated fashion and will be identified by the same reference numerals (with the subscript "a") as their counterparts in FIGS. 1–8. With this in mind, the modified wheel chair 10*a* has a base 12*a* supported on front wheels 22*a* and rear swivel wheels 24*a*. In this embodiment, the rear swivel wheels 24*a* are rotatable laterally of the base to their solid line extended positions of FIG. 11 when the wheel chair is in use and to their broken line retracted positions of the latter figure for ease of storage and transportation of the wheel chair. Within the base are motors 126*a* drivably connected to the front wheels 22*a* and a battery 124*a*.

Rising from the base 12*a* is a hydraulic lifter 20*a* including a lower relatively stationary piston 38*a* and an upper movable cylinder 40*a*. The lower end of the piston fits removably within a socket 41*a* on the base. The piston is releasably secured within the socket 42*a* and attached by a bolt 44*a* to an upstanding support 45*a* on the base. A hydraulic fluid tank 46*a* is attached to the upper end of the cylinder 40*a*. Mounted on a bracket-line cross arm 90*a* on the cylinder are a manual hydraulic pump 82*a*, a motor driven hydraulic pump 84*a*, and a solenoid valve 86*a* which are hydraulically connected to the hydraulic fluid tank 46*a* and the hydraulic lifter 20*a* in the same way as the manual pump, motor driven pump, and solenoid valve in FIGS. 1–8.

The manual pump 82*a* is operable by an L-shaped handle 96*a* which is rotatably journalled at one end in the upper end of the lifter cylinder and extends outwardly from the lifter 20*a* laterally of the wheel chair and then forwardly of the lifter. The manual pump is operable by up and down pumping motion of the forward end of this pump handle. Secured at one end to the lifter cylinder diametrically opposite the pump handle 96*a* is an L-shaped support arm 115*a* which extends outwardly from the lifter laterally of the wheel chair and then forwardly of the lifter. Mounted on the forward end of this arm is a control unit 28*a* which is electrically connected to and selectively operable by the wheel chair user to energize the motor driven pump 84*a*, the solenoid valve 86*a*, the battery 124*a*, and the front wheel drive motors 126*a* all in the same way as the control unit in FIGS. 1–8. This electrical connection between the control unit and the battery and front wheel drive motors includes an electrical cable 118*a* having a plug 120*a* for insertion into an electrical socket 122*a* in the upper side of the base 12*a*.

At the front side of the lifter 20*a*, between the pump handle 96*a* and the control unit support arm 115*a* is a support member 58*a* in the form of a generally open rectangular support frame having a rear bracket 60*a* attached to the upper end of the lifter cylinder 40*a*. A seat 14*a* comprising a panel of strong flexible sheet material is pivotally secured along its rear edge to the lower end of the support frame 58*a* by a rod 64*a* which extends through seam along the rear edge of the panel. Extending through a seam along the front edge of the seat panel is a rod 68*a* whose ends are secured to the upper ends of two seat struts 66*a*. Extending between and pivotally joined at their ends to the lower end of the frame 58*a* and the upper ends of the struts 66*a* are seat side members 67*a*. The lower ends of the seat struts 66*a* are pivotally secured by pivot bolts 70*a* to upstanding brackets 72*a* on the base 12*a* adjacent the lower end of the lifter piston 38*a*.

At the upper end of the support frame 58*a* is an upper body support 16*a*. This upper body support comprises a horizontal bar 76*a* extending across the upper end of the frame and a pair of padded upper body support arms 78*a* slidably mounted on and extending forwardly of the bar. These support arms have screws 80*a* for releasably securing the arms in fixed positions along the bar 76*a*. The wheel chair user is positioned between the pump handle 96*a* and the control unit support arm 115*a* with his arms extending over the upper body support arms 78*a* so that these support arms engage under the user's arm pits.

Piston 38*a* has an adjustable stop 39*a* for arresting downward movement of the cylinder 40*a* when the seat 14*a* is substantially horizontal. The piston 38 of the lifter 20 on the earlier described wheel chair 10 may also have such an adjustable stop, as shown.

The modified wheel chair is otherwise essentially identical to and operates in the same manner as the wheel chair of FIGS. 1–8. Accordingly, it is evident that the modified wheel chair 10*a* is selectively operable by the wheel chair user to support the user in sitting and standing positions. The user is physically but gently lifted to standing position during upward extension of the lifter 20*a* and gently lowered to sitting position during downward retraction of the lifter. The wheel chair can be driven forwardly and rearwardly and steered by the user.

I claim:

1. A prosthetic device for lifting and lowering a user of the device to and supporting the user in an upright standing position and a sitting position, said device comprising:

a base, a lifter on said base operable by the user in elevating and lowering modes and having a lifter axis disposed in a fixed position and at a fixed angle relative to said base such that said axis is at least nearly vertical when said base is supported on a horizontal surface, said lifter including a stationary lifter part which is fixed to said base against movement relative to the base and a movable lifter part which moves upwardly along said axis relative to said base during operation of the lifter in its elevating mode and moves downwardly along said axis relative to said base during operation of the lifter in its lower mode, a seat above said base having front and rear edges and a normally underside, an upper body support including a pair of user support arms above said seat spaced laterally of said base for engaging under and in vertical supporting relation with the user's arm pits, mounting means mounting said upper body support on said movable lifter part for up and down movement of said upper body support with said movable lifter part and pivotally mounting said rear seat edge on said movable lifter part for up and down movement of said rear seat edge with said movable lifter part and pivotal rotation of said seat on a rear pivot axis extending along said rear seat edge transverse to said lifter axis and laterally of said base, seat strut means at the normally underside of said seat pivotally secured at one end to said seat adjacent said front seat edge on a front pivot axis parallel to said rear pivot axis and pivotally mounted at the other end on a lower pivot axis below and parallel to said rear pivot axis and having a normally fixed position relative to said base, and wherein said strut means rotates in one direction on said lower pivot axis and said seat undergoes combined rotation on said rear pivot axis and forward edgewise translation to a generally horizontal user seating position during downward movement of said movable lifter part along said lifter axis in said lifter lowering mode, and said strut rotates in the other direction on said lower pivot axis and seat undergoes combined rotation on said rear pivot axis and rearward edgewise translation to a generally upright user standing position during upward movement of said movable lifter part along said lifter axis in said lifter elevating mode.

2. A prosthetic device according to claim 1 including:

means for adjusting said lower pivot axis along said lifter axis to adjust the height of said seat and the height of said upper body support above said base in said user seating and standing positions.

3. A prosthetic device according to claim 1 wherein:

said mounting means comprises a support member extending longitudinally of and secured to the movable lifter part for up and down movement of said support member with said movable lifter part, means securing said upper body support to said support member for up and down movement of said upper body support with said support member, and means pivotally securing said rear seat edge to said support member for up and down movement of said rear seat edge with said support member and pivotal rotation of said seat relative to said support member on said rear pivot axis.

4. A prosthetic device according to claim 3 including:

means for adjusting said lower pivot axis longitudinally of said lifter axis relative to said base to adjust the height of said upper body support above said base in said user standing position and the height of said upper body support and said seat above said base in said user seating position.

5. A prosthetic device for lifting and lowering a user of the device to and supporting the user in an upright standing position and a sitting position, said device comprising:

a base, a seat above said base, an upper body support including a pair of user support arms above said seat for engaging under the user's arm pits in vertical supporting relation with the user's upper body, positioning means operatively connecting said base, seat and upper body support and operable by the user for effecting (a) downward movement of said seat and said upper body support in unison relative to said base to user seating positions, wherein said seat is extended to seat the user in said sitting position and said user support arms are lowered relative to said base for engagement under and in vertical supporting engagement with the user's arm pits to support the user in said sitting position, and (b) upward movement of said seat and upper body support in unison relative to said base to user standing positions wherein said user support arms are elevated relative to said base for engagement under and in vertical supporting relation with the user's arm pits to support the user in said standing position and said seat is retracted to permit the user to occupy said standing position, user actuated means easily accessible to the user for operating said positioning means, and wherein said positioning means are selectively operable by the user in an elevating mode to effect movement of said upper body support and said seat from said user seating positions to said user standing positions and in a lowering mode to effect movement of said upper body support and said seat from said user standing positions to said user seating positions all while said user support arms remain in vertical supporting engagement with the user's arm pits in such a way that said user support arms physically lift the user's body by the arm pits from said sitting position to said standing position and said seat retracts during operation of said positioning means in said elevating mode and said user support arms physically lower the user's body by the arm pits from said standing position to said sitting position and said seat extends during operation of said lifter positioning means in said lowering mode, said positioning means comprises a lifter operable in an elevating mode and a lowering mode and having a lifter axis which extends upwardly from said base at a fixed angle relative to said base such that said lifter axis is generally upright when said base is supported on a horizontal surface, and said lifter includes a lower stationary lifter part fixed to said base, an upper movable lifter part which moves upwardly along said lifter axis relative to said base during operation of the lifter in its elevating mode and moves downwardly along said lifter axis relative to said base during operation of the lifter in its lowering mode, said seat has front and rear edges, said positioning means further comprises mounting means mounting said upper body support and said rear seat edge on said movable lifter part for up and down movement of said upper body support and said rear seat edge with said movable lifter part and pivotal rotation of said seat on a rear pivot axis located below said upper body support and extending along said rear seat edge transverse to said lifter axis and laterally of said base, and seat strut means pivotally joined at one end to said seat adjacent said front seat edge on a front pivot axis parallel to said rear pivot axis and pivoted at the other end on a fixed lower pivot axis below said rear pivot axis and parallel to said front and rear pivot axes, said strut means rotates in one direction on said fixed lower pivot axis and said seat undergoes combined rotation and forward edgewise translation to its horizontal user seating position during downward movement of said movable lifter part in said lifter lowering mode, and said strut means rotates in the other direction on said fixed lower pivot axis and said seat undergoes combined rotation and rearward edgewise translation to a generally upright user standing position during upward movement of said movable lifter part in said lifter elevating mode, said lifter comprises an upstanding hydraulic lifter including a piston which constitutes one of said lower stationary and upper movable lifter parts and a cylinder which constitute the other of said lower stationary and upper movable lifter parts, and said positioning means comprises a hydraulic system connected to said lifter including means easily accessible to the user in said sitting position and said standing position for operating said hydraulic system to selectively feed hydraulic fluid under pressure to and vent hydraulic fluid from said lifter to effect upward and downward movement of said movable lifter part relative to said stationary lifter part.

6. A prosthetic device according to claim 5 wherein:

said hydraulic system comprises a hydraulic fluid storage tank mounted on said movable lifter part, and hydraulic means mounted on said movable lifter part and operable by the user for selectively pumping hydraulic fluid from said tank to said lifter to raise said movable lifter part and venting hydraulic fluid from said lifter to said tank to lower said movable lifter part, whereby said storage tank and said hydraulic means move up and down with said movable lifter part.

7. A prosthetic device according to claim 5 wherein:

said mounting means comprises a support member extending longitudinally of and secured to said movable lifter part, means securing said upper body support to said support member for up and down movement of said support member and said upper body support with said movable lifter part, and hinge means pivotally securing said rear seat edge to said support member on said rear pivot axis.

8. A prosthetic device according to claim 6 wherein:

said hydraulic means comprises a manual pump having a pump handle to be moved by the user to operate the pump.

9. A prosthetic device according to claim 6 wherein:

said hydraulic means comprises a motor driven pump, and said hydraulic system comprises an electrical control system connected to said motor driven pump including a control unit to be operated by the user for selectively energizing said motor driven pump.

10. A prosthetic device for lifting and lowering a user of the device to and supporting the user in an upright standing position and a sitting position, said device comprising a base, a seat above said base, an upper body support above said seat engagable in vertical supporting relation with the user's upper body, positioning means operatively connected to said seat and said upper body support and selectively operable by the user to raise said upper body support and seat relative to said base to elevated positions and lower said upper body support and seat relative to said base to lowered positions in such a way that (a) said seat when in its lowered position is disposed to seat the user in said sitting position and said upper body support when in lowered position is disposed to engage the sitting user's body in vertical supporting relation, (b) said upper body support when in its elevated position is disposed to support the user in said standing position and said seat is retracted to clear the standing user, and (c) said upper body support raises and lowers between its elevated and lowered positions along a certain axis which has a fixed angle relative to said base and is generally upright when said base is supported on a horizontal surface, whereby said upper body support is adapted to physically lift the user by his upper body from said sitting position to said standing position and to physically lower the user by his upper body from said standing position to said sitting position, and wherein said positioning means comprises a lifter operable in elevating and lowering modes and including a relatively stationary lower lifter part fixed to said base, an upper relatively movable lifter part which moves upwardly along said certain axis relative to said base during operation of the lifter in its elevating mode and moves downwardly along said certain axis relative to said base during operation of the lifter in its lowering mode, said seat has front and rear edges, said positioning means further comprises means securing said upper body support to said movable lifter part for up and down movement of said upper body support along said certain axis with said movable lifter part, means pivotally securing said rear seat edge to said movable lifter part on a rear pivot axis extending along said rear seat edge transverse to said certain axis for up and down movement of said rear seat edge along said certain axis with said movable lifter part, and seat strut means pivotally joined at one end to said seat adjacent said front seat edge on a front pivot axis parallel to said rear pivot axis and pivoted at the other end on a fixed lower pivot axis below said rear seat edge, said strut means rotates in one direction on said fixed lower pivot axis and said seat undergoes combined rotation and forward edgewise translation to its lowered position during downward movement of said movable lifter part in said lifter lowering mode, and said strut means rotates in the other direction on said fixed lower pivot axis and said seat undergoes combined rotation and rearward edgewise translation to its elevated position during upward extension of said movable lifter part in said lifter elevating mode, said lifter comprises a hydraulic lifter including a cylinder and a piston which constitute said lifter parts, respectively, and said positioning means comprises a hydraulic system connected to said lifter including means easily accessible to the user in every position of said seat and upper body support for operating said hydraulic system to selectively feed hydraulic fluid under pressure to and vent hydraulic fluid from said lifter.

11. A prosthetic device according to claim 10 wherein: said movable lifter part is said cylinder, and said hydraulic system comprises a hydraulic fluid storage tank mounted on said cylinder, and hydraulic means mounted on said cylinder for selectively pumping hydraulic fluid from said tank to said lifter.

12. A prosthetic device according to claim 10 wherein:

said base comprises one component, said lifter comprises a second component, and said seat, upper body support, and seat strut means comprise a third components which components are separable for ease of storage and transportation of said device, and said device comprises relatively quick release connecting means releasably joining said separable components including first releasable connecting means securing lower end of said lower lifter part to said base, second releasable connecting means securing said upper body support and seat to said movable lifter part, and third releasable connecting means at said other end of said seat strut means.

13. A prosthetic device according to claim 12 wherein:

said third releasable connecting means connects said other end of said strut means to said lower lifter part and is adjustable along said lower lifter part to adjust the height of said seat and said upper body support above said base in their elevated and lowered positions.

14. A prosthetic device according to claim 10 wherein:

said base comprises one component, said lifter comprises a second component, and said seat, upper body support, and seat strut means comprise a third components which components are separable for ease of storage and transportation of said device, and said device comprises relatively quick release connecting means releasably joining said separable components including first releasable connecting means securing said lower lifter part to said base, second releasable connecting means securing said upper body support and seat to said movable lifter part, and third releasable connecting means pivotally securing said other end of said seat strut means to base adjacent said lower lifter part.

15. A prosthetic device for lifting and lowering a user of the device to and supporting the user in an upright standing position and a sitting position, said device comprising:

a base, a seat for supporting the user in said sitting position, an upper body support engagable in vertical supporting relation with the user's upper body, positioning means operatively connected to said seat and said upper body support including a lifter having a lifter axis and operable by the user for effecting movement of said seat and said upper body support along said lifter axis between (a) user seating positions, wherein said seat is extended to seat the user in said sitting position and said upper body support is lowered relative to said base for engagement in supporting relation with the user's upper body when in said sitting position, and (b) user standing positions wherein said upper body support is elevated relative to said base for engagement in supporting relation with the user's upper body when in said standing position and said seat is retracted to permit the user to occupy said standing position, user actuated means easily accessible to the user in said user seating and user standing positions for operating said lifter, and wherein said lifter is selectively operable by the user in an elevating mode wherein said positioning means effects movement of said upper body support and said seat from said user seating positions to said user standing positions and in a lowering mode wherein said positioning means effects movement of said upper body support and said seat from said user standing positions to said user sitting positions all while said upper body support remains in vertical supporting engagement with the user's body in such a way that said upper body support physically lifts the user's body from said sitting position to said standing position and said seat retracts during operation of said lifter in said elevating mode and said upper body support physically lowers the user's body from said standing position to said sitting position and said seat extends during operation of said lifter in said lowering mode, said lifter comprises an upstanding hydraulic lifter assembly including a lower stationary lifter part fixed to said base and a movable lifter part movable upwardly relative to said stationary lifter part during operation of the lifter in its elevating mode and downwardly relative to said stationary lifter part during operation of the lifter in its lowering mode, said lifter parts comprising a piston and a cylinder, respectively, said user actuated means comprise a hydraulic system connected to said lifter for selectively feeding hydraulic fluid under pressure to and venting hydraulic fluid from said lifter, said hydraulic system comprises a hydraulic fluid storage tank mounted on said movable lifter part, and hydraulic means mounted on said movable lifter part for selectively pumping hydraulic fluid from said tank to said lifter and venting hydraulic fluid from said lifter, whereby said storage tank and said hydraulic means move up and down with said movable lifter part, said seat has front and rear edges, said positioning means comprises a support member extending longitudinally of and secured to said movable lifter part and mounting said upper body support for up and down movement of said support member and said upper body support with said movable lifter part, means pivotally securing said rear seat edge to said support member on a rear pivot axis below said upper body support and transverse to said lifter axis, and seat strut means pivotally joined at one end to said seat adjacent said front seat edge on a front pivot axis parallel to said rear pivot axis and pivoted at the other end on a fixed lower pivot axis adjacent the lower end of said stationary lifter part and parallel to said front and rear pivot axes, and said strut means undergoes rotation in one direction on said fixed lower pivot axis and said seat undergoes combined rotation and forward edgewise translation to a generally horizontal user seating position during downward movement of said movable lifter part, and said strut means undergoes rotation in the opposite direction on said fixed pivot axis and said seat undergoes combined rotation and rearward edgewise translation to a generally upright user standing position wherein said support member, seat, and strut means are disposed substantially in a common plane parallel to the longitudinal axis of said lifter during upward movement of said movable lifter part.

16. A prosthetic device for lifting and lowering a user of the device to and supporting the user in an upright standing position and a sitting position, said device comprising:

a base, a seat for supporting the user in said sitting position, an upper body support engagable in vertical supporting relation with the user's upper body, positioning means operatively connected to said seat and said upper body support including a lifter having a lifter axis and operable by the user for effecting movement of said seat and said upper body support along said lifter axis between (a) user seating positions, wherein said seat is extended to seat the user in said sitting position and said upper body support is lowered relative to said base for engagement in supporting relation with the user's upper body when in said sitting position, and (b) user standing positions wherein said upper body support is elevated relative to said base for engagement in supporting relation with the user's upper body when in said standing position and said seat is retracted to permit the user to occupy said standing position, user actuated means easily accessible to the user in said user seating and user standing positions for operating said lifter, and wherein said lifter is selectively operable by the user in an elevating mode wherein said positioning means effects movement of said upper body support and said seat from said user seating positions to said user standing positions and in a lowering mode wherein said positioning means effects movement of said upper body support and said seat from said user standing positions to said user sitting positions all while said upper body support remains in vertical supporting engagement with the user's body in such a way that said upper body support physically lifts the user's body from said sitting position to said standing position and said seat retracts during operation of said lifter in said elevating mode and said upper body support physically lowers the user's body from said standing position to said sitting position and said seat extends during operation of said lifter in said lowering mode, said lifter comprises an upstanding hydraulic lifter assembly including a lower stationary lifter part having a lower end mounted on said base, an upper movable lifter part which moves upwardly relative to said stationary lifter part during operation of the lifter in its elevating mode and downwardly relative to said stationary lifter part during operation of the lifter in its lowering mode, said user actuated means comprise a hydraulic system connected to said lifter for selectively feeding hydraulic fluid under pressure to and venting hydraulic fluid from said lifter to effect upward and downward movement of said movable lifter part relative to said stationary lifter part, said hydraulic system comprises a hydraulic fluid storage tank mounted on said movable lifter part, and hydraulic means mounted on said movable lifter part for selectively pumping hydraulic fluid from said tank to said lifter to raise said movable lifter part and venting hydraulic fluid from said lifter to said tank to lower said movable lifter part, whereby said storage tank and said hydraulic means move up and down with said movable lifter part, said seat has front and rear edges, said positioning means comprises a support member extending longitudinally of and secured to said movable lifter part and mounting said upper body support for up and down movement of said support member and said upper body support with said movable lifter part, means pivotally securing said rear seat edge to said support member on a rear pivot axis below said upper body support and transverse to said lifter axis, and seat strut means pivotally joined at one end to said seat adjacent said front seat edge on a front pivot axis parallel to said rear pivot axis and pivoted at the other end on a fixed lower pivot axis adjacent the lower end of said stationary lifter part and parallel to said front and rear pivot axes, said strut means undergoes rotation in one direction on said fixed lower pivot axis and said seat undergoes combined rotation and forward edgewise translation to a generally horizontal user seating position during downward movement of said movable lifter part, and said strut means undergoes rotation in the opposite direction on said fixed pivot axis and said seat undergoes combined rotation and rearward edgewise translation to a generally upright user standing position wherein said support member, seat, and strut means are disposed substantially in a common plane parallel to said lifter axis during upward movement of said movable lifter part.

17. A prosthetic device for lifting and lowering a user of the device to and supporting the user in an upright standing position and a sitting position, said device comprising:

a base, a lifter on said base operable by the user in elevating and lowering modes and and having a lifter axis disposed in a fixed position and at a fixed angle relative to said base such that said axis is at least nearly vertical when said base is supported on a horizontal surface, said lifter comprising a stationary lifter part which is fixed to said base against movement relative to the base and a movable lifter movable upwardly along said axis relative to said stationary lifter part during operation of the lifter in its elevating mode and downward movement along said axis relative to said stationary lifter part during operation of the lifter in its lowering mode, means operable by the user for selectively operating said lifter in its elevating and lowering modes, a seat above said base, an upper body support above said seat for vertically supporting the user's body above the waist, means mounting said upper body support on said movable lifter part for up and down movement of said upper body support along said lifter axis with said movable lifter part, and means for extending said seat during downward movement of said movable lifter part and upper body support along said lifter axis in said lifter lowering mode and to a user seating position wherein said seat is generally horizontally disposed below said upper body support and retracting said seat during upward movement of said movable lifter part and upper body support along said lifter axis in said lifter elevating mode and to a user standing position wherein the seat is disposed to permit the user to stand with his lower body and legs under said upper body support.

18. A prosthetic device according to claim 17 wherein:

said upper body support comprises two generally parallel, laterally spaced support arms disposed in a plane transverse to said certain axis for engagement under and in vertical supporting engagement with the user's arm pits.

19. A prosthetic device according to claim 17 wherein:

said lifter comprises a hydraulic lifter including a piston member, and a cylinder member receiving said piston member, and said stationary lifter part comprises one of said piston and cylinder members, and said movable lifter part comprises the other of said piston and cylinder members.

20. A prosthetic device according to claim 17 wherein:

said base, said lifter, and said seat and upper body support are separable for ease of storage and transportation of said device, and said device includes releasable connecting means releasably joining said base, lifter, and said seat and upper body support.

21. A prosthetic device according to claim 17 wherein:

said seat has front and rear edges, and said last mentioned means comprises a pivotal connection between said rear seat edge and said movable lifter part having a rear pivot axis extending along said rear seat edge, and strut means pivotally connected at one end to said seat adjacent said front seat edge on a front pivot axis parallel to said rear pivot axis and pivoted at the other end on a fixed lower pivot axis below said seat on a lower pivot axis parallel to said rear and front pivot axes.

22. A prosthetic device according to claim 21 including:

means for adjusting said lower pivot axis along said lifter axis to adjust the elevation of said seat and upper body support above said base.

23. A prosthetic device according to claim 17 including:

means for adjusting the elevation of said upper body support and said seat above said base.

* * * * *